United States Patent [19]

Takizawa et al.

[11] 4,258,671

[45] Mar. 31, 1981

[54] VARIABLE VALVE LIFT MECHANISM USED IN AN INTERNAL COMBUSTION ENGINE

[75] Inventors: Masaaki Takizawa, Mishima; Kazuo Takahashi; Noboru Matsubara, both of Susono, all of Japan

[73] Assignee: Toyota Jidosha Kogyo Kabushiki Kaisha, Toyota, Japan

[21] Appl. No.: 9,965

[22] Filed: Feb. 6, 1979

[30] Foreign Application Priority Data

Mar. 13, 1978 [JP] Japan ..... 53-27797

[51] Int. Cl.[3] ..... F01L 1/34

[52] U.S. Cl. ..... 123/90.16

[58] Field of Search ..... 123/90.12, 90.14, 90.15, 123/90.16, 90.17, 90.49, 90.53, 90.55, 90.56, 90.58

[56] References Cited

U.S. PATENT DOCUMENTS

| | | | |
|---|---|---|---|
| 3,385,274 | 5/1968 | Shunta et al. | 123/90.16 |
| 3,439,661 | 4/1969 | Weiler | 123/90.16 |
| 4,111,165 | 9/1978 | Aoyama et al. | 123/90.15 |

*Primary Examiner*—Harry N. Haroian

*Attorney, Agent, or Firm*—Finnegan, Henderson, Farabow, Garrett & Dunner

[57] ABSTRACT

A hydraulic tappet is used in a variable valve lift engine. The tappet comprises an outer case having a pressure chamber formed therein, an inner case having an oil chamber formed therein and engaged within the outer case, and a check valve disposed between the pressure chamber and the oil chamber. The pressure chamber is communicated with an electromagnetic valve via an additional check valve. The electromagnetic valve is actuated in accordance with changes in operating conditions of an engine, i.e. the engine load and the temperature of the engine, so that the oil pressure between the additional check valve and the electromagnetic valve is maintained at a predetermined level. As a result, the valve lift of the engine can be varied at an optimum level in accordance with changes in the operating conditions of the engine.

8 Claims, 1 Drawing Figure

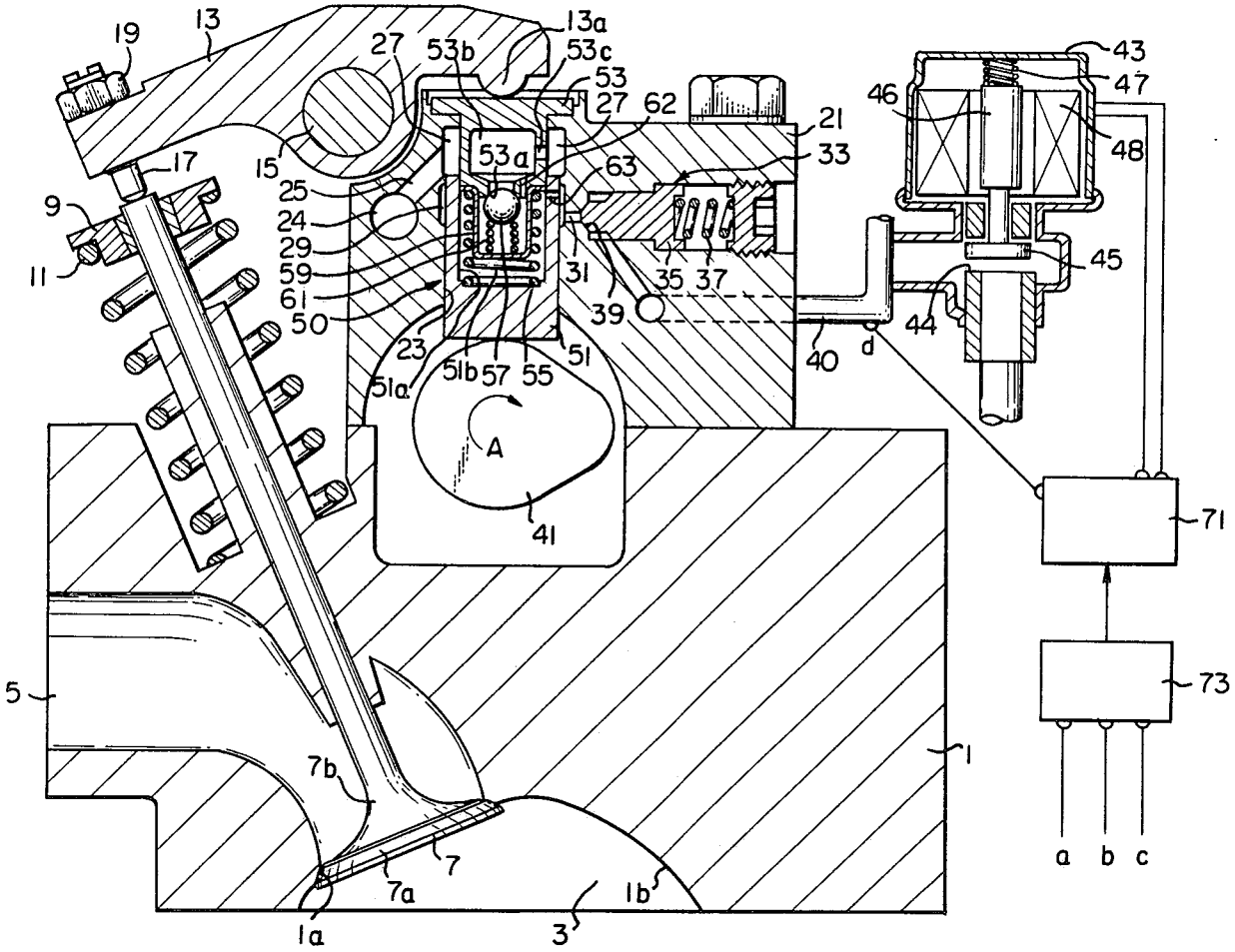
71
73
a
b
c
43
47
48
45
46
44
d
40
21
33
37
35
62
63
39
13a
53c
53
27
31
51
41
55
53a
57
A
53b
51b
23
51a
27
25
24
29
59
61
50
15
13
17
19
9
11
1
1b
3
7
7a
7b
1a
5

VARIABLE VALVE LIFT MECHANISM USED IN AN INTERNAL COMBUSTION ENGINE

TECHNICAL FIELD OF THE INVENTION

This invention relates to a variable lift mechanism used in an internal combustion engine, especially to a variable lift mechanism of an internal combustion engine wherein a hydraulic tappet is utilized.

BACKGROUND ART OF THE INVENTION

It is well known to utilize a hydraulic tappet so that noise generated by valve mechanism can be reduced. Such a hydraulic tappet has an outer case which is in contact with a cam rotated in synchronism with a crankshaft of the engine. The outer case has an inner case, slidably and sealingly engaged therein, which actuates a valve of the internal combustion engine via rocker arm. The outer case also has a pressure chamber formed therewithin. A check valve is disposed inside or outside the pressure chamber and oil under pressure is supplied into the pressure chamber through the check valve. Accordingly, when the oil under pressure is supplied into the pressure chamber, the outer case is urged outwardly and is in contact with the cam, and the inner case is in contact with the rocker arm. When a force is applied to the outer surface from the outside thereof, due to the actuation of the check valve, the supply of the oil under pressure is stopped, and then, the hydraulic tappet serves to transmit the movement of the cam to the rocker arm.

If an orifice of a small diameter is opened to the pressure chamber, the oil under pressure flows out through the orifice. Since the amount of the flow of the oil is proportional to the time interval which is required for one cycle of the cam, the amount of the oil flow at a low rotational speed of the engine is large because the time interval for one cycle is long. As a result, the hydraulic tappet is contracted a large amount, and the lift of the valve is reduced a large amount. On the other hand, at a high rotational speed of the engine, the amount of the lift reduction of the valve is small. As mentioned above, the valve lift of the engine can be varied in accordance with changes in rotational speed of the internal combustion engine.

However, the above-mentioned mechanism can vary the valve lift of an internal combustion engine in accordance with only changes in the rotational speed of an internal combustion engine and the valve lift of the engine cannot be varied in accordance with other factors. As a result, the desired operating characteristics of the engine cannot be obtained by varying the valve lift in accordance with changes in predetermined factors, except for the rotational speed, of the engine.

To overcome the above mentioned problem, U.S. Pat. No. 3,439,661 discloses a controlled displacement hydraulic lifter, wherein the pressure chamber of the hydraulic tappet is communicated with a sliding spool control valve via an additional check valve, so that the lifting action of the lifter is controlled by the sliding spool control valve. However, in this lifter, the spool control valve is not controlled in conjunction with changes in operating conditions of the engine, such as the engine load and the temperature of the engine.

SUMMARY OF THE INVENTION

The principal object of the present invention is to provide a variable valve lift mechanism used in an internal combustion engine which can control the valve lift in accordance with changes in operating characteristics of the engine, and in which the pressure chamber of the hydraulic tappet is communicated with a valve device which is controlled in accordance with changes in operating conditions of the engine.

In an embodiment of the present invention, an electromagnetic valve is utilized as the valve device. Signals which are obtained, based on the engine load and the rotational speed of the engine, are passed through a circuit which includes a fundamental algebraic component, and then, another signal is obtained. The latter obtained signal is modified on the basis of the temperature of the oil under pressure, and the modified signal is utilized to actuate the electromagnetic valve. In addition, the pressure level of the oil under pressure between the pressure chamber and the electromagnetic valve is feed-back controlled at a predetermined level, so that the valve lift is maintained at an optimum level.

In a preferred embodiment of the present invention, the electromagnetic valve is ON-OFF controlled. Due to the combination result of the ON-OFF control and the above-mentioned feed back control, the control according to the preferred embodiment is easier and more precise than that of the above-mentioned U.S. Pat. No. 3,439,661, wherein the flow is controlled by means of position control of the spool valve.

In an embodiment of the present invention which will be described later with reference to the accompanying drawing, the present invention is applied to an engine of over head cam type (OHC type). The present invention is also applicable to an engine of over head valve type (OHV type), which is not illustrated herein. In the latter case, a push rod is disposed between the cam and the rocker arm.

BRIEF DESCRIPTION OF THE DRAWINGS

An embodiment according to the present invention will be explained hereinafter with reference to the accompanying drawing, wherein the FIGURE is a cross sectional elevational view of the embodiment according to the present invention.

DISCLOSURE OF THE INVENTION

Referring to the accompanying FIGURE, a cylinder block (not shown) has a cylinder bore formed therein and a piston (not shown) is reciprocatingly and sealingly engaged within the cylinder bore. A cylinder head 1, having a recess 1*b* formed thereon, is fixedly mounted on the cylinder block so that a combustion chamber 3 is formed at a space surrounded by the cylinder bore, the recess 1*b* and the piston. The cylinder head 1 has an intake port 5 and an exhaust port (not shown) formed therein. The intake port 5 and the exhaust port are communicated with the combustion chamber via an intake valve 7 and an exhaust valve (not shown), respectively.

The intake valve 7 and the exhaust valve have constructions similar to each other, and therefore, only the actuating mechanism of the intake valve 7 will now be explained hereinafter. The intake valve 7 comprises a valve body 7*a* and a valve rod 7*b* fixed to the valve body 7*a*. The valve body 7*a* is so constructed that it is capable of being in abutment with a valve seat 1*a* formed on the cylinder head 1. A retainer 9 is fixed at the upper end of the valve rod 7*b*. A compression spring 11 is disposed between the retainer 9 and the cylinder head 1, so that the intake valve 7 is urged upwardly and that the valve body 7*a* is pressed against the valve seat 1*a*. A knocker 17, adjustably threaded to a rocker arm 13, is so constructed that it can press the upper end of the valve rod 7*b*. The length of the knocker can be adjusted to a desired length by means of a lock nut 19. The rocker arm 13 is swingable about a rocker shaft 15 and has a rocker pad 13*a* projected therefrom at one end thereof. The rocker pad 13*a* is in abutment with the upper end of an inner case 53 of a hydraulic tappet 50. The hydraulic tappet 50 is engaged in a hole 23 formed in a support 21. The support 21 is fixed on the cylinder head 1.

The hydraulic tappet 50 comprises: an outer case 51 slidably engaged in the hole 23 and having an inner wall 51*a* and a pressure chamber 51*b*; the inner case 53 slidably and sealingly engaged in the inner wall 51*a* and having an oil chamber 53*b* formed therein; a compression spring 55 which urges the inner case upwardly with respect to the outer case 51, and; a check valve 57 disposed between the pressure chamber 51*b* and the oil chamber 53*b*. The check valve 57 is urged to a valve seat 53*a* formed at the lower surface of the inner case 53 by means of a compression spring 61. The compression spring 61 is supported by a retainer having a U shaped cross section and secured to the lower end of the inner case 53. An orifice 62 having a small diameter is formed in the proximity of the valve seat 53*a*, so that the pressure chamber 51*b* is communicated with the oil chamber 53*b* by the orifice 62. The orifice 62 may be omitted in some cases.

An oil supply (not shown) which is driven by the engine is communicated with a journal 24 formed within the support 21 in a direction perpendicular to the sheet on which the FIGURE is illustrated. The journal 24 is communicated with the oil chamber 53*b* through a supply passage 25, annular groove 27 formed around the surface of the inner case 53 and a small hole 53*c* formed in the wall of the inner case 53, so that the oil under pressure is supplied into the oil chamber 53*b* from the oil supply.

An orifice 63 of a small diameter is formed in the wall of the outer case 51, at a position higher than the valve seat 53*a*, which cooperates with the check valve 57 and is communicated with an annular groove 29 which surrounds the outer case 51. The annular grooves 29 (only one is illustrated) of all the cylinders are communicated by a single pipe 40 via oil relief ports 31 (only one is illustrated) and check valves 33 (only one is illustrated). The pipe 40 is communicated with an electromagnetic valve 43.

The check valve 33 comprises a slidable valve body 35, which is urged to a valve seat 39 by a compression spring 37 so that a reverse oil flow toward the hydraulic tappet is prevented.

A bottom end of the outer case 51 is in abutment with the cam 41 which is rotated, in a direction designated by an arrow A, in synchronism with a crankshaft (not shown) of the engine.

The electromagnetic valve 43 comprises a valve seat 44 and a valve body 45, which cooperates with the valve seat 44. A valve rod 46 fixed to the valve body 45 is urged toward the valve seat 44 by means of a compression spring 47 and is also reversely urged by means of an electromagnetic coil 48 when the electromagnetic coil is energized. The electromagnetic coil 48 is energized by a signal emitted from a control 71.

A temperature detecting sensor (not shown), which is of conventional type and which is disposed in a cooling system (not shown) of the engine, detects the temperature of the engine and transmits a signal a. A signal b is transmitted from an engine load sensor (not shown) which is of a conventional type and which is disposed at an intake pipe (not shown) of the engine, so that the sensor can detect the engine load by detecting the vacuum in the intake pipe. A sensor of tachometer type (not shown) transmits a signal c which corresponds to the rotational speed of the engine. The signals a, b and c are input into an electric computer 73, and then, these signals are processed in accordance with predetermined algebraic equations. The result from the computer 73 is transmitted to the controller 71 as a target value of the energizing signal for the electromagnetic coil 48.

A signal d is transmitted in accordance with changes in oil pressure in the pipe 40 from a conventional pressure sensor disposed in the pipe 40 and is input into the controller 71. As a result, the electromagnetic coil 48 of the electromagnetic valve 41 is so actuated that the signal d can be maintained at the predetermined target value transmitted from the computer 73. In some cases, the actuating signal introduced into the electromagnetic coil 48 may be an ON-OFF signal, wherein ON and OFF signals are continued for certain time intervals, respectively. In some cases, the actuating signal of the electromagnetic coil 48 may be a pulse width modulation signal, so that the amount of flow passing through the electromagnetic valve 43 is continuously controlled in accordance with the signal level.

The oil under pressure, supplied from the journal 24, flows into the oil chamber 53*b* and the pressure chamber 51*b*, so that the bottom end of the outer case 51 is in abutment with the cam and that the upper end of the inner case 53 is in abutment with the rocker arm pad 13*a*. As a result, since no gaps are generated between the hydraulic tappet 50 and the cam 41 and between the hydraulic tappet 50 and the rocker arm pad 13*a*, the generation of noise is reduced relative to a conventional fixed type tappet.

When the cam 41 rotates, it presses the outer case 51 upwardly, and the oil pressure in the pressure chamber 51*b* is increased. As a result, the check valve 57 is closed, so that the oil under pressure in the pressure chamber 51*b* is prevented from flowing therefrom to the oil chamber 53*b* through the check valve 57. Accordingly, in this case the oil tappet 50 moves as if it were almost a solid body, and the movement of the cam 41 is transmitted to the rocker arm pad 13*a* almost without effecting any changes thereto.

On the other hand, the oil under pressure in the pressure chamber 51*b* flows into the oil chamber 53*b* through the orifice 62. Since the amount of the oil flow is proportional to the time interval per one cycle of the engine, a large amount of oil flows out when the rotational speed of engine is low, because the time interval per one cycle is long then, and then the length of the hydraulic tappet is contracted and the valve lift is shortened. As a result, the valve lift is varied in accordance with changes in the rotational speed of the engine.

However, if the oil is permitted to flow out only through the orifice 62, the valve lift of the engine at a certain rotational speed is determined only depending on the rotational speed of the engine. Therefore, the valve lift of the engine cannot be controlled in accordance with changes in engine load and temperature of the engine. In the present invention, the electromagnetic valve 43 is controlled in conjunction with the operating conditions of the engine, such as the engine load, the temperature of the engine and the rotational speed of the engine, so that the oil under pressure flows from the pressure chamber 51*b* in conjunction with the operating conditions of the engine and that the valve lift is controlled. As a result, in the present invention the optimum valve lift in conjunction with the operating conditions of the engine can be obtained. In addition, a feed-back control, wherein the pressure of the oil between the electromagnetic valve 43 and the hydraulic tappet 50 is controlled so that it maintains a predetermined value is applied such that, the valve lift can be optimum for a wide range of operating conditions of the engine.

In the illustrated embodiment, since the orifice 63 is positioned at a higher position than the valve seat 53*a* of the check valve 57, the oil under pressure does not leak from the pressure chamber while the electromagnetic valve 43 is deactuated, and therefore, a shock of the hydraulic tappet, which shock is inherent in a hydraulic tappet having no oil therein, does not occur when the engine is restarted.

What we claim is:

1. A variable valve lift mechanism for cooperating with a crankshaft-synchronized cam and a rocker arm to actuate a valve in an internal combustion engine, said mechanism comprising:

an outer case having a pressure chamber formed therein, one end of said outer case abutting said cam;

an inner case having an oil chamber formed therein and being slidably and sealingly disposed in said outer case, one end of said inner case abutting one end of said rocker arm;

a first check valve disposed between said pressure chamber and said oil chamber for controlling one-way fluid communication from said oil chamber to said pressure chamber;

an electromagnetic valve actuated in response to changes in operating conditions of said engine, said electromagnetic valve being in fluid communication with said pressure chamber;

a second check valve disposed between said pressure chamber and said electromagnetic valve for controlling one-way fluid communication from said pressure chamber to said electromagnetic valve; and a pressure sensor disposed between said second check valve and said electromagnetic valve for sensing the fluid pressure therein and for permitting actuation of said electromagnetic valve to maintain said sensed fluid pressure at a predetermined level.

2. The valve lift mechanism of claim 1 also including an engine load sensor for detecting engine load as an operating condition of said engine.

3. The valve lift mechanism of claim 1 also including a temperature sensor for detecting engine temperature as an operating condition of said engine.

4. The valve lift mechanism of claim 1 also including a speed sensor for detecting engine rotational speed as an operating condition of said engine.

5. The valve lift mechanism of claim 1 wherein said first check valve is disposed within said pressure chamber and wherein said outer case has an opening for fluid communication between said pressure chamber and said electromagnetic valve, said opening being located above the seat of said first check valve.

6. A variable lift valve mechanism for cooperating with a crankshaft-synchronized cam and a rocker arm to actuate a valve in an internal combustion engine, said mechanism comprising:

an outer case having a pressure chamber formed therein, one end of said outer case abutting said cam;

an inner case having an oil chamber formed therein and being slidably and sealingly disposed in said outer case, one end of said inner case abutting one end of said rocker arm;

a first check valve disposed between said pressure chamber and said oil chamber for controlling one-way fluid communication from said oil chamber to said pressure chamber;

an electromagnetic valve actuated in response to changes in operating conditions of said engine, said electromagnetic valve being in fluid communication with said pressure chamber;

an engine load sensor in electrical communication with said electromagnetic valve for detecting engine load as an operating condition of said engine;

a temperature sensor in electrical communication with said electromagnetic valve for detecting engine temperature as an operating condition of said engine;

a second check valve disposed between said pressure chamber and said electromagnetic valve for controlling one-way fluid communication from said pressure chamber to said electro-magnetic valve; and a pressure sensor in electrical communication with said electromagnetic valve disposed between said second check valve and said electromagnetic valve for sensing fluid pressure therein, whereby said electromagnetic valve is actuated in response to said engine load and temperature for maintaining said sensed fluid pressure at a predetermined level.

7. The valve lift mechanism as in claim 6 also including a speed sensor in electrical communication with said electromagnetic valve for detecting engine speed as an operating condition of said engine and for actuating said electromagnetic valve in response to said engine speed for maintaining said sensed fluid pressure at a predetermined level.

8. The valve lift mechanism as in either of claims 1 or 6 wherein said electromagnetic valve is actuated by a pulse width modulated signal.

* * * * *